US012788155B2

(12) United States Patent
Biebl

(10) Patent No.: US 12,788,155 B2
(45) Date of Patent: Nov. 10, 2026

(54) MATTRESS

(71) Applicant: Boris Biebl, Bottrop (DE)

(72) Inventor: Boris Biebl, Bottrop (DE)

( * ) Notice: Subject to any disclaimer, the term of this patent is extended or adjusted under 35 U.S.C. 154(b) by 794 days.

(21) Appl. No.: 18/019,830

(22) PCT Filed: Aug. 1, 2021

(86) PCT No.: PCT/EP2021/071512
§ 371 (c)(1),
(2) Date: Jun. 29, 2023

(87) PCT Pub. No.: WO2022/029048
PCT Pub. Date: Feb. 10, 2022

(65) Prior Publication Data

US 2024/0285091 A1 Aug. 29, 2024

(30) Foreign Application Priority Data

Aug. 6, 2020 (DE) ..... 102020120836.7

(51) Int. Cl.
*A47C 27/15* (2006.01)
*A47C 21/04* (2006.01)
*A47C 27/14* (2006.01)

(52) U.S. Cl.
CPC ..... *A47C 27/15* (2013.01); *A47C 21/046* (2013.01); *A47C 27/144* (2013.01); *A47C 27/146* (2013.01)

(58) Field of Classification Search
CPC ..... A47C 27/15; A47C 27/146; A47C 27/144; A47C 27/148; A47C 27/14; A47C 21/046; A47G 2009/1018
See application file for complete search history.

(56) References Cited

U.S. PATENT DOCUMENTS 3,258,791 A 7/1966 Kaplan
4,276,666 A * 7/1981 Yamada ..... A47C 27/144 5/736
4,673,452 A * 6/1987 Awdhan ..... A47C 27/15 156/254
4,924,542 A * 5/1990 Yamaguchi ..... A47C 27/16 5/951
4,999,868 A * 3/1991 Kraft ..... A47C 27/146 5/736
5,160,785 A * 11/1992 Davidson, Jr. ..... A47C 27/146 5/736
5,327,597 A * 7/1994 Rothbard ..... A47C 27/146 5/736
6,272,707 B1 * 8/2001 Robrecht ..... A47C 27/146 5/724
6,782,575 B1 * 8/2004 Robinson ..... A47C 27/15 5/736
2019/0365117 A1 * 12/2019 Schwartz ..... A47C 27/085

FOREIGN PATENT DOCUMENTS

DE 202015101439 U1 6/2015
JP 2015159951 A 9/2015

* cited by examiner

*Primary Examiner* — Matthew Troutman
*Assistant Examiner* — Alison N Labarge
(74) *Attorney, Agent, or Firm* — Biotech Beach Law PC; Raymond Wagenknecht

(57) ABSTRACT

The invention relates to a mattress (10) comprising a mattress body (1), a support surface (2*o*, 2*u*) for a person to lie upon, and a mattress edge surface (4) extending peripherally around the mattress base body, the support surface (2) and/or the mattress edge surface (4) having a plurality of elevations (3*i*, 3*a*, 3*r*).

10 Claims, 5 Drawing Sheets

MATTRESS

CROSS REFERENCE TO RELATED APPLICATIONS

This application is the U.S. national stage of International Application No. PCT/EP2021/071512, filed on 2021 Aug. 1. The international application claims the priority of DE 102020120836.7 filed on 2020 Aug. 6; all applications are incorporated by reference herein in their entirety.

BACKGROUND

The invention relates to a mattress.

When using a mattress for sleeping, a considerable amount of moisture is secreted by the user, which penetrates into the mattress and especially into the mattress base. Conventional mattresses offer only an insufficient possibility for the removal of this moisture.

U.S. Pat. No. 4,999,868 A, JP 2015-159 951 A, and DE 20 2015 101 439 U1 disclose different mattresses that have a plurality of elevations at least on the top surface.

SUMMARY

It is the object of the invention to provide an improved mattress, in particular to improve the removal of moisture from the mattress. The object underlying the invention is solved by the object according to one of the main claims. Embodiments are subject of the subclaims and the description.

The mattress according to the invention enables improved moisture removal. This is achieved in particular by providing elevations on the mattress base body, between which free spaces remain in which air can circulate. The circulating air can absorb and remove the moisture. It is also achieved that a contact area between the user and the mattress base body is limited to the higher areas of the elevations. The reduced contact area effects that already few moisture is introduced into the mattress base body by the user.

The particular shape of the elevations also enables an outline of the mattress, in particular of the mattress cover stretched around the mattress base body, which is as close as possible to an ideal cuboid. The so-called visitor's crevice between two mattresses in a double bed can be as small as possible despite the outer elevations in the rim area. This enables an almost continuous support surface even in a double bed with two adjacent mattresses.

The elevations are designed in particular as, in particular straight, cones, in particular as pyramids, i.e. as cones with an angular base surface. The base surface is in particular a rectangle, in particular a square.

Such a mattress can be part of a box-spring arrangement. A base mattress and/or a topper mattress of the box-spring arrangement can be designed as the mattress described above.

In one embodiment, the elevations on the bottom of the topper mattress, in particular when viewed from above, are designed to be opposite to elevations on a top side of the base mattress. This prevents the topper mattress from sliding sideways on the base mattress.

In one embodiment, the height of the elevations on the bottom of the topper mattress is different from the elevations on the top of the base mattress. This allows air spaces to be formed between the base mattress and the topper mattress, which promotes the removal of moisture from both mattresses. The height difference is in particular at least 20%.

In one embodiment, a height of the outer and/or inner elevations is at least 3 cm and/or max. 5 cm.

In one embodiment, the first height is at least 3 cm and/or a maximum of 5 cm.

In one embodiment, third and/or fourth height is max. 80%, in particular max. 60% of the first height.

In one embodiment, the second height is max. 80%, in particular max. 60% of the third and/or the fourth height or vice versa.

In one embodiment, the fifth height is at least 0.5 cm, in particular at least 1 cm and/or max. 3 cm, in particular max. 2 cm.

BRIEF DESCRIPTION OF THE DRAWINGS

The invention is explained in more detail below with reference to the figures; herein shows:

FIG. 1;

DETAILED DESCRIPTION OF THE PREFERRED EMBODIMENTS

Figure 1:
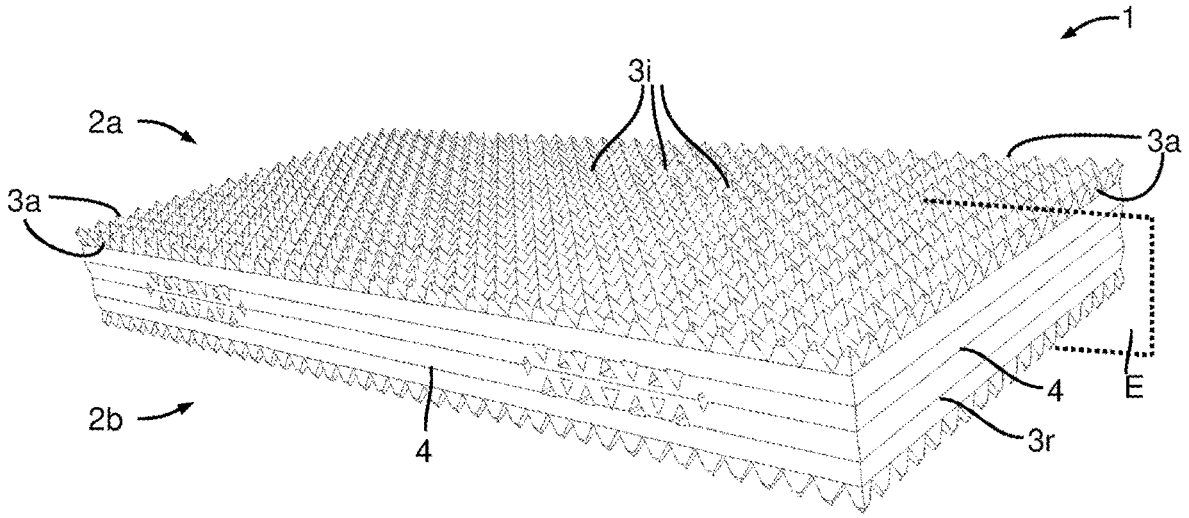
FIG. 1 a mattress according to the invention in perspective view.
Figure 2:
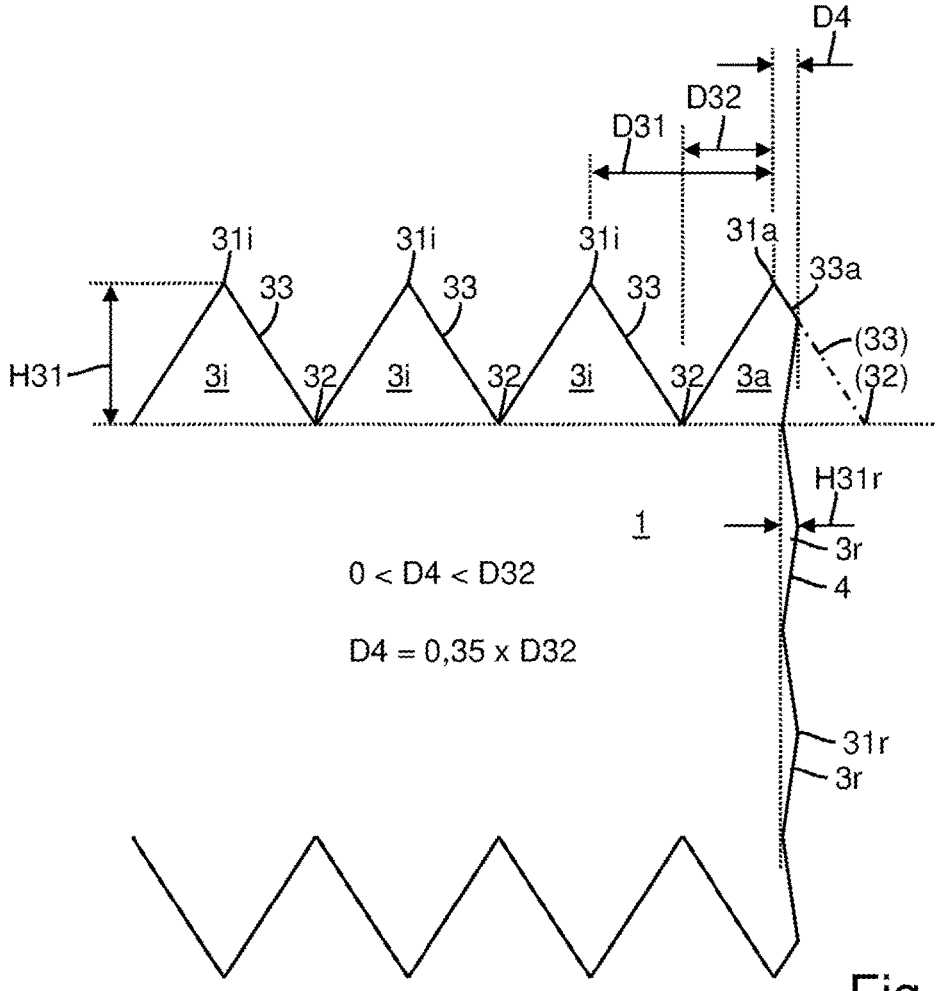
FIG. 2 a cross-section through the mattress along the sectional plane E of FIG. 1.

FIGS. 1 and 2 are described together below. The mattress 10 according to the invention comprises a mattress base body 1. The mattress base body 10 comprises a support surface 2. In this example, the mattress base body 10 comprises a first support surface 2*a* and a second support surface 2*b* on opposite sides. Depending on the rotational position of the mattress, a user may lie on the respective upside lying support surface. The mattress comprises a mattress cover covering the mattress base body at least in sections.

In particular, the mattress base 10 is formed from a foam material.

In the following, the first support surface, which is located at the top according to the figures, will be discussed in more detail. Of course, the description also applies to the second support surface with the provision that the directional information then also refers to the case where this second support surface is arranged at the top by rotating the mattress.

The mattress forms a circumferential mattress rim surface 4 around the mattress. The mattress rim surface 4 is oriented substantially perpendicular to the support surfaces. During intended use, the mattress rim surface 4 is oriented vertically.

As FIGS. 1 and 2 show, the mattress rim surface 4 itself or partial surfaces can deviate from an exactly vertical alignment. For this purpose, the mattress rim surface 4 also has rim elevations 3*r*, which can also keep the mattress cover 9 at a partial distance from the mattress base body 1. Here, too, the above-mentioned advantages with regard to moisture entry and removal are achieved.

The support surface 2 comprises a plurality of elevations 3*i*, 3*a*, respectively, which project upwardly from the support surface 2. The elevations 3*i*, 3*a* form the highest points of the mattress base body 1 and thus in particular form a support structure for supporting a person lying on the mattress. Because only the elevations support the person, the contact area between the person and the mattress base body or between a mattress cover and the mattress base body is comparatively small. This leads to reduced transfer of moisture to the mattress base body. The formation of free spaces between the elevations also allows air to circulate better, which is useful for moisture removal.

The elevations 3*i*, 3*a* have in particular the shape of cones. In the present case, the cones are formed as pyramids, with a lower base 32 defined by a base surface and upper tips 31. A lateral surface 33 is arranged between the base 32 and the tip 31. Viewed in cross-section through the apex, the elevations have in particular the shape of an isosceles triangle.

Figure 9:
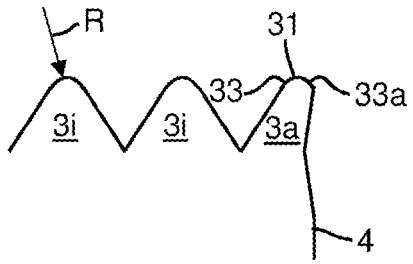

The tips 31 of the elevations 3 are shown as points in FIGS. 1 to 8; as an alternative to this representation, the tips can also be rounded within the scope of the invention, as FIG. 9 illustrates. A radius of curvature R of the tips is in particular max. 10 mm, in particular max. 5 mm.

In particular, the surface area defining the base 32 is formed as a square. In other words. Viewed from above, the elevation has the shape of a square.

The elevations are distinguished between inner elevations 3*i* and outer elevations 3*a*. The outer elevations intersect with the mattress rim surface 4. In this respect, the outer elevations have the shape of vertically cut cones (see in particular FIG. 2).

All other elevations that are not outer elevations 3*a* are referred to as internal elevation 3*i*.

Figure 3:
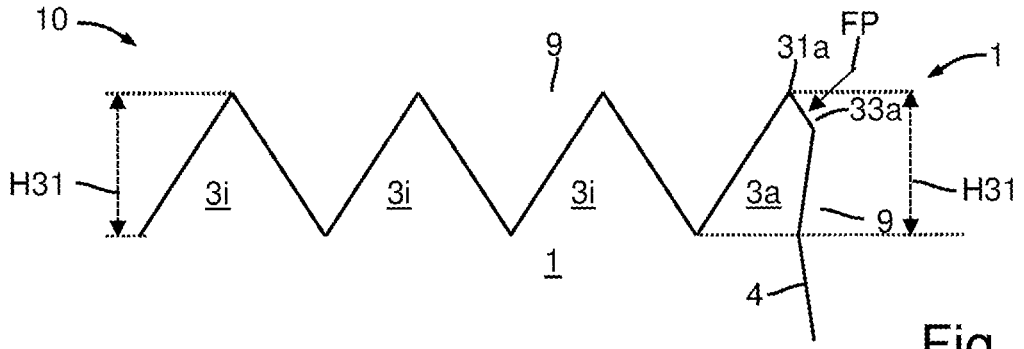
FIG. 3 the cross section from FIG. 1 with mattress cover.
Figure 4:
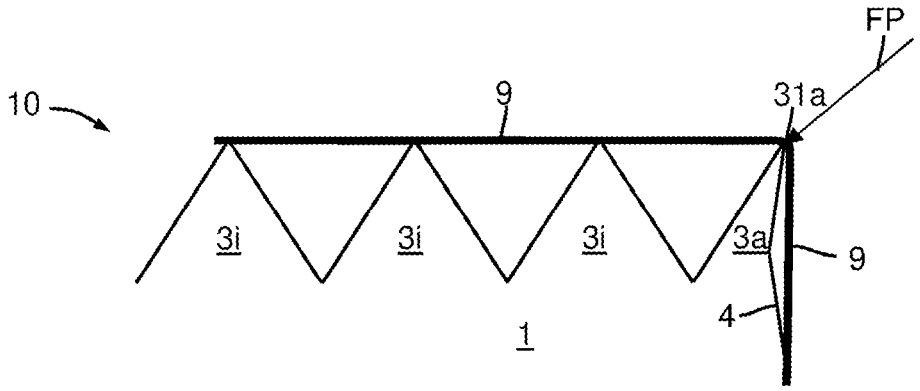
FIG. 4 a first comparative example analogous to FIG. 3.
Figure 5:
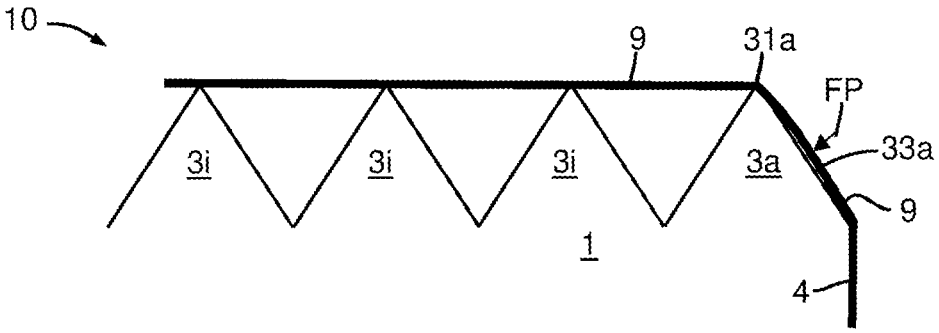
FIG. 5 a second comparative example analogous to FIG. 3.

The special feature now lies in the shape of the outer elevations 3*a* or in the position of the section of the outer elevations 3*a*, which is explained with the aid of comparative examples based on FIGS. 3 to 5.

During use, the mattress base body 1 is enclosed by a mattress cover 9 at least on the top side. This mattress cover 9 is in particular a fitted sheet, which can apply a considerable tension force to the mattress base body 1. FIGS. 3 to 5 each show a surface pressure FP arising in the region of the rim of the mattress base body, i.e. where the support surface 2 intersects with the mattress rim surface 4.

FIG. 4 shows a comparative mattress in which the mattress rim surface 4 intersects the elevation exactly at the tip 31*a* of the outer elevation 3*a*. In an idealized assumption the mattress cover 9 thus assumes a rectangular cross-sectional shape at the rim. The mattress, i.e. the arrangement comprising the mattress base body and the mattress cover, would thus have an ideal cuboid shape. Two mattresses arranged next to each other in a double bed can thus lie ideally against each other, with the so-called visitor's crevice being as small as possible. However, this can only be achieved in an idealized view. This is because the surface pressure FP at the tip 31*a* assumes a very high value, which causes the tip to buckle. The rectangular shape of the mattress can therefore not be realized in reality.

FIG. 5 shows a comparative mattress in which the mattress rim surface 4 intersects the elevation exactly at the base 32 of the outer elevation 3*a*. In an idealized assumption, the mattress cover 9 thus assumes a sloping shape. The surface pressure FP at the outer elevation 3*i* and at the apex 31*a* assumes a comparatively low value, since the mattress cover 9 can support itself against a large outer envelope surface 33*a*. The mattress, i.e. the arrangement comprising the mattress base body and the mattress cover, would thus not have an ideal cuboid shape. Two mattresses arranged side by side in a double bed would thus form a distinct visitor's crevice.

FIG. 3 shows a mattress according to the invention in which the mattress rim surface 4 intersects the outer elevation 3*a* between the tip 31*a* and the imaginary base 32 (the base 32 is therefore no longer part of the mattress base body). Consequently, a cut cone is formed. Due to the cut between the tip 31*a* and the mattress rim surface 4, a cut lateral surface 33*a* remains between the mattress rim surface and the tip 31*a*, against which the mattress cover 9 can be supported. A surface pressure FP is thus lower than the surface pressure at the comparative example of FIG. 4. In addition, the outward protrusion 31*a* is provided with more material in the vicinity of the tip, which increases its resistance to bending compared to the comparative example of FIG. 4. It is true that the optimum right-angle shape of the comparative example of FIG. 5 is not achieved. Overall, however, it is advantageous that almost a rectangular shape can be realistically created at the edge between the support surface and the mattress rim surface.

In one embodiment, when viewed from above, a rim distance D4 of the outer tip 31*a* to the mattress rim surface 4 is less than a base distance D32 of the outer tip 31*a* to a closest base 32 of the elevation 31. For example, the rim distance D4 is 50% of the base distance D32.

The manufacture of the mattress base is described with reference to FIG. 6. A rectangular foam block 99 is shown in doted lines as the raw material. A plurality of identical half bodies 91 are cut out of the foam block. Two such half-base bodies 91 are then reassembled to form a common mattress base body. In this way, the mattress bodies can be produced from the cuboid foam block with as little scrap as possible.

In particular, it can be seen that the cut lateral surface 33*a* of an outer elevation 3*a* is produced by a cut at which the uncut rim surface 33 is simultaneously produced. For production reasons, it is therefore advantageous if the outer boundary of the outer elevation forms the shape of the cut outer surface or if the outer elevation is basically based on the same shape as the inner elevation 3*i*.

Figure 6:
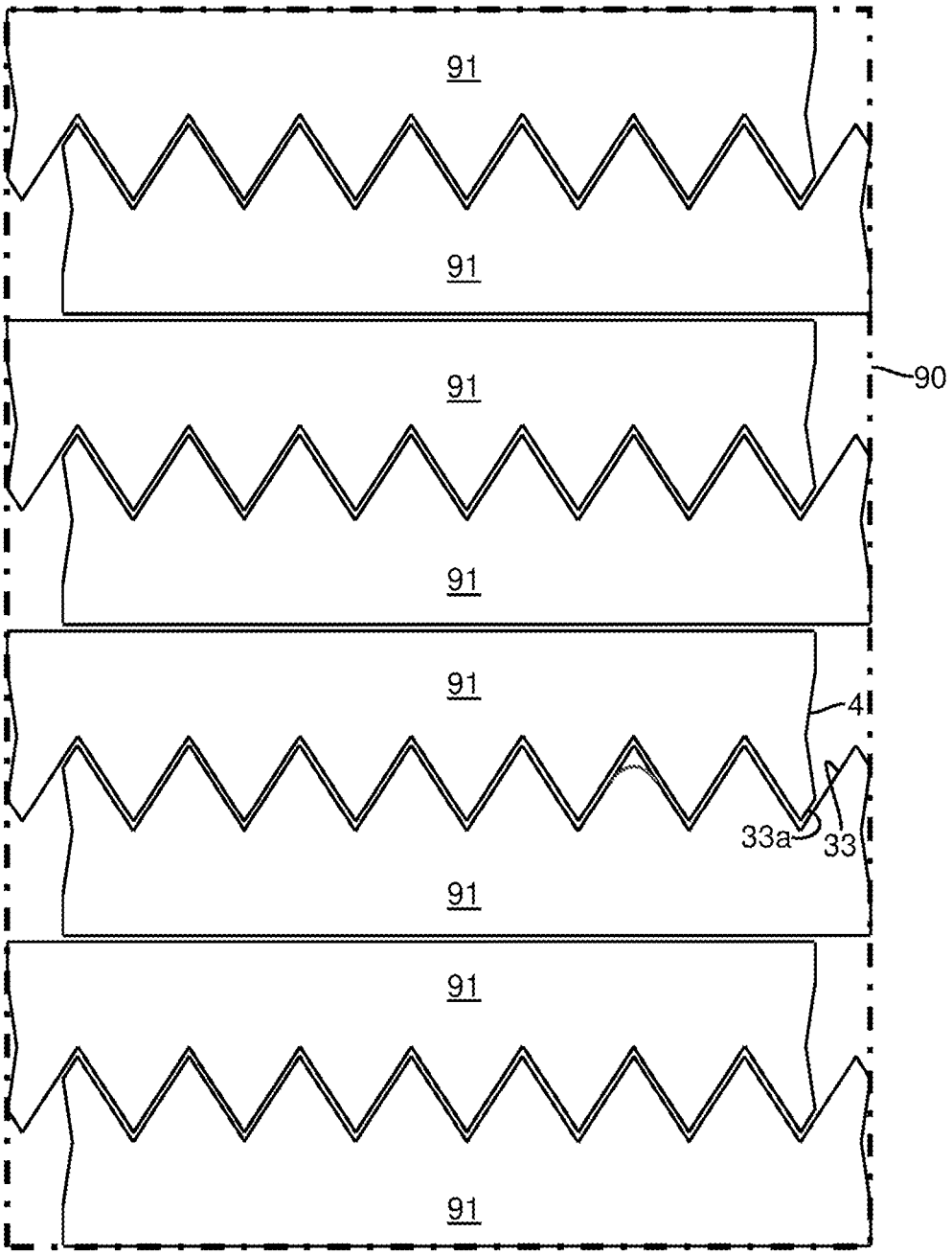
FIG. 6 a foam block for the production of a plurality of semi-base bodies.
Figure 7:
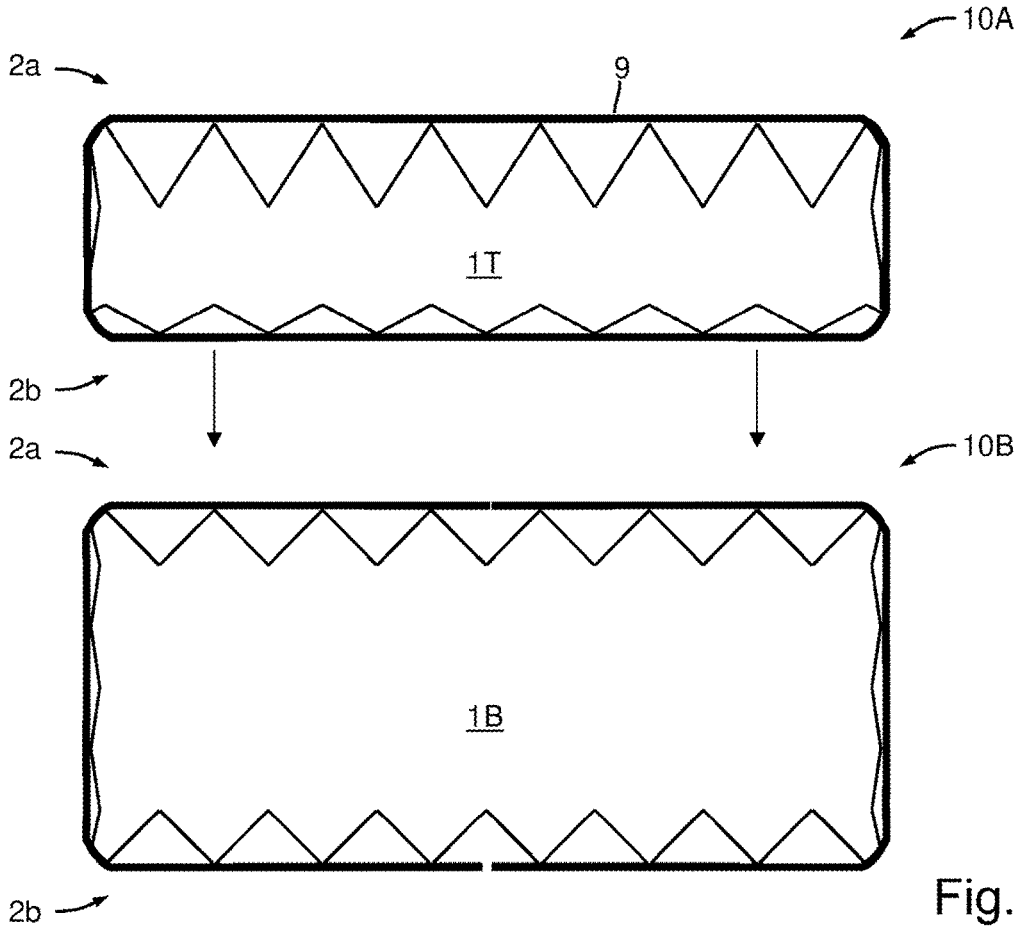
FIG. 7 a cross-section of a box-spring arrangement with a base mattress and a topper mattress, each separately.
Figure 8:
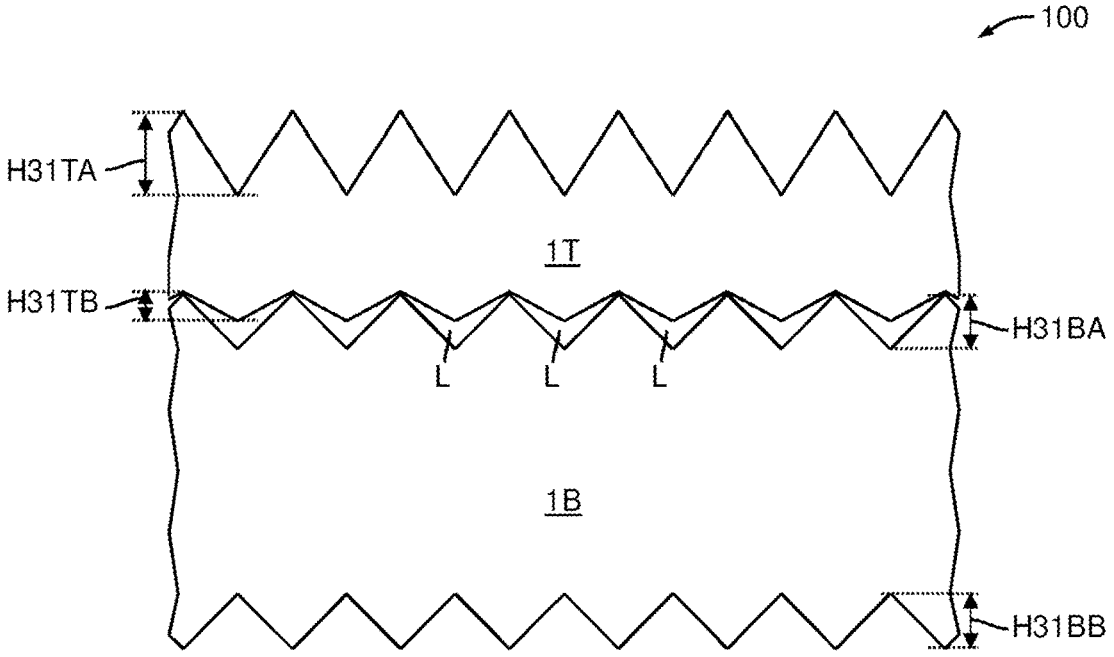
FIG. 8 a cross-section through the box-spring arrangement according to FIG. 7 with a base mattress and a topper mattress lying on top of each other FIG. 9 a detailed cross-sectional view of tips of the mattress according to FIG. 10 a top view of the mattress according to FIG. 1.

FIGS. 6 and 7 show a box-spring arrangement 100 according to the invention with a base mattress 10B and a topper mattress 10T resting thereon. The two mattresses each comprise a base body 1T, 1B, each of which may be at least partially enclosed by a mattress cover (shown only in FIG. 7). The above description regarding the mattress according to the invention applies respectively to the topper mattress 10T and to the base mattress 10B. In this respect, all of the above features are applicable to the topper mattress and/or to the base mattress, either isolated or in combination.

The topper mattress 10T rests with a bottom side 2*b* on a top side 2*a* of the base mattress 10B. A person can lie on the top side 2*a* of the topper mattress 10T. The base mattress can assume the function of a slatted frame.

The base mattress 10B protrudes with its elevations 31 on the top side 2*a* into interspace of the top mattress 10T, the interspaces between the protrusions 31 being formed on the bottom side 2*b* of the top mattress 10T. Alternatively expressed, the topper mattress 10T protrudes with its elevations 31 at the bottom side 2*b* into interspaces of the base mattress 10B, the interspaces between the elevations 31 being formed at the top side 2*a* of the base mattress 10B.

The elevations at the top side 2A of the topper mattress 10T have a first height H31TA. The elevations 31 at the bottom side 2B of the topper mattress 10T have a second height H31TB. The elevations at the top side 2A of the base mattress 10B have a third height H31BA. The elevations 31 at the bottom side 2B of the base mattress 10B have a fourth height H31BB.

In one embodiment, the first height H31TA is larger than the second height H31TB.

In one embodiment, the second height H31TB is different from the third height H31BA and/or the fourth height H31BB, in particular lower than the third height H31BA and/or the fourth height H31BB. As a result, an air space L remains between the mattresses, even if they lie on top of each other, by which improved moisture removal is possible.

The figures are not to scale and are intended only as a schematic representation of the structure. The number of elevations shown is also not to be regarded as binding. In particular, there may be significantly more elevations along a side length of the mattress than shown in each case.

Figure 10:
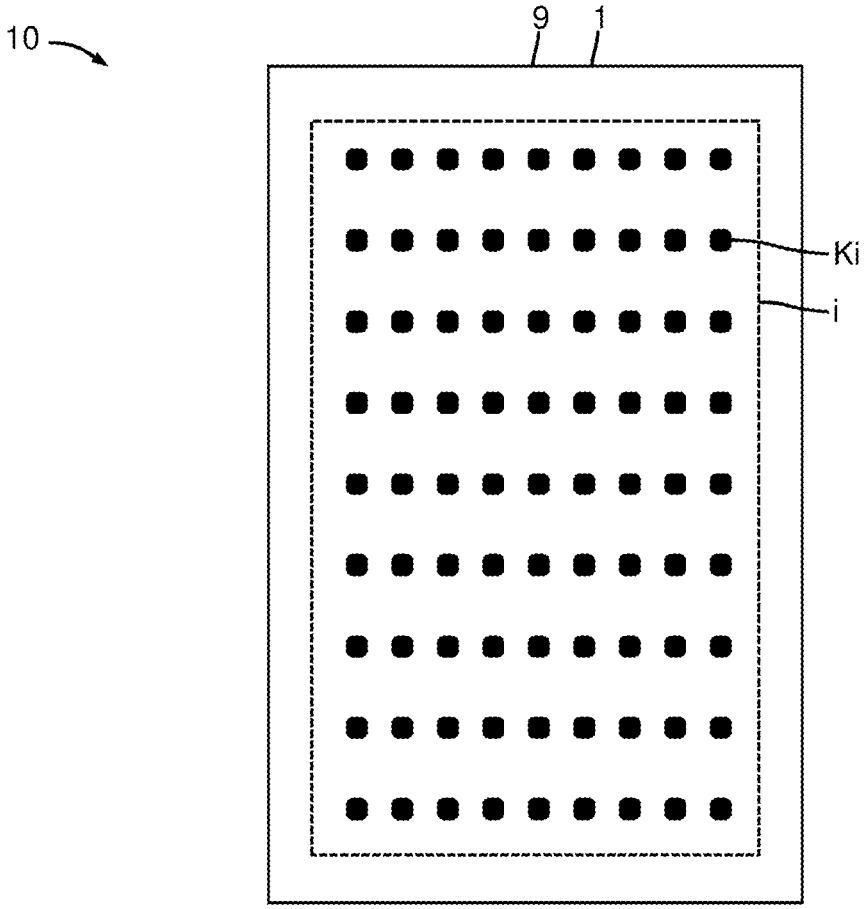

FIG. 10 shows the mattress from above. The mattress base 1 is covered by the mattress cover 9. A support area i of the inner elevations is shown dashed. In this support area i, the inner elevations 3*i* are arranged behind the mattress cover 9. Due to the tension of the mattress cover, an inner contact surface Ki results between each inner elevation 3*i* and the mattress cover 9. One or more of the following properties is assigned to the inner contact surface (these properties are independent of the shape of the outer elevations):

In a state in which no user is resting on the mattress (unloaded state), the inner contact area is max. 1 square centimeter, in each case as viewed from above.

In a state in which no user is resting on the mattress, the sum of the inner contact areas is max. 5%, preferably max. 1% of the total area of the inner support area i, in each case viewed in top view.

LIST OF REFERENCE NUMERALS

1 mattress base body
1B base mattress base body
1T topper mattress base body
2*a* first support surface/top side
2*b* second support surface/bottom side
3 elevation/cone
3*i* inner elevation
3*a* outer elevation
3*r* elevation on the mattress rim surface
4 mattress rim surface
9 mattress cover
10 mattress
10B base mattress
10T topper mattress
100 box-spring arrangement
31 tip
31*i* tip of inner elevation
31*a* tip of outer elevation
31*r* tip of rim elevation
32 base
33 lateral surface
33*a* cut lateral surface
90 foam block
91 semi-base body
FP surface pressure
E section plane
L air space
D31 distance between elevations
D32 base distance between tip and base of an elevation
D4 rim distance
H31 general height of inner and outer elevations
H31TA first height
H31TB second height
H31BA third height
H31BB fourth height
H31*r* fifth height of the mattress rim surface
i inner support area of the inner elevations
Ki inner contact surface between inner elevation and mattress cover

The invention claimed is:

1. Mattress (10), comprising:

a mattress body (1) having a support surface (2*a*, 2*b*) for supporting a user and a mattress rim surface (4) surrounding the mattress body, wherein the support surface (2) has a plurality of elevations (3*i*, 3*a*, 3*r*), characterized in that the support surface (2) has inner elevations (3*i* ) and outer elevations (3 *a*) which adjoin the circumferential mattress rim surface (4), wherein the outer elevations (3*a*) having a shape which differs from the inner elevations (3*i*), that the outer elevations (31*a*) each have an outer tip (31 *a*) which are each arranged in such a way that, viewed in top view, a rim distance (D4) of the outer tip (31*a*) from the mattress rim surface (4) is less than a base distance (D32) of the outer tip (31*a*) from a nearest base (32) of the elevation (31), that the rim distance (D4) is a minimum of 10% of the base distance (D32), and that the rim distance (D4) is a maximum of 80% of the base distance (D32).

2. Mattress according to claim 1, characterized in that the inner elevations (3*i*) having the shape of cones.

3. Mattress according to claim 1, characterized in that the outer elevations (3 *a*) each form the shape of a laterally truncated cone.

4. Mattress according to claim 1, characterized in, that the inner elevations (3*i*) are each formed as cones, and that the outer cones (3*a*) are each formed as cones with the provision that the outer elevations (3 *a*) are partially cut off by the circumferential mattress rim surface (4).

5. Mattress according to claim 1, characterized in that the inner elevations (3*i*) each have an inner tip (31 *i*) and in that the outer elevations each have an outer tip (31 *a*), the inner tip and the outer tip having an identical first height (H31) starting from a base (24).

6. Mattress according to claim 1, characterized in, in that the mattress (10) is at least partially covered with a mattress cover (9), and in that the mattress cover (9) bears against the elevations in such a way that the mattress cover (9) is held at least in sections at a distance from the mattress base body (1).

7. Mattress according to claim 6, characterized in that a contact area (Ki) is formed between an inner elevation (3*i*) and the mattress cover (9) in the unloaded state, the contact area (Ki) being max. 1 square centimeter.

8. Mattress according to claim 6, characterized in that a contact surface (Ki) is formed between an inner elevation (3*i*) and the mattress cover (9) in the unloaded state, the sum of all contact surfaces (Ki) in an inner support region (i) amounting to max 1% of the inner support region (i).

9. Mattress according to claim 1, characterized in that the mattress rim surface (4) has a plurality of rim elevations (41), the rim elevations (3*r*) having in particular a fifth height (H31*r*).

10. Box-spring arrangement (100) comprising a base mattress (10B) and a topper mattress (10T), wherein a bottom side (2B) of the topper mattress (10T) rests on a top side (2A) of the base mattress (10B), wherein the base mattress (10B) and/or the topper mattress (10T) is formed as a mattress according to claim 1.

* * * * *